US005195667A

United States Patent [19]

Gallant

[11] Patent Number: 5,195,667

[45] Date of Patent: Mar. 23, 1993

[54] TOOL HOLDER

[76] Inventor: David Gallant, Box 109, Newfield, Me. 04056

[21] Appl. No.: 778,339

[22] Filed: Oct. 16, 1991

Related U.S. Application Data

[63] Continuation of Ser. No. 375,672, Jul. 5, 1989, abandoned.

[51] Int. Cl.[5] ..... A45F 5/00

[52] U.S. Cl. ..... 224/197; 224/248; 224/253; 224/904

[58] Field of Search ..... 224/253, 904, 196, 197, 224/198, 199, 200, 247, 248

[56] References Cited

U.S. PATENT DOCUMENTS

| | | | |
|---|---|---|---|
| 1,326,887 | 12/1919 | Wood . | |
| 2,956,715 | 10/1960 | Henderson . | |
| 3,100,590 | 8/1963 | Bohlson | 224/904 |
| 3,104,434 | 9/1963 | Noorhoek | 224/904 |
| 4,106,679 | 8/1978 | Hillinger | 224/197 |
| 4,372,468 | 2/1983 | Harvey | 224/904 |
| 4,638,530 | 1/1987 | Perry | 224/904 |
| 4,645,104 | 2/1987 | Vokaty | 224/904 |
| 4,790,461 | 12/1988 | Stover | 224/904 |

*Primary Examiner*—Linda J. Sholl
*Attorney, Agent, or Firm*—Ralph W. Selitto, Jr.

[57] ABSTRACT

A device for suspending T-shaped tools from a belt, toolbox, wall, or other mount, comprising a flat attachment material and a rotating holder body which secures the tool while allowing the tool to be inserted and removed from different angles. In order to ensure that the holder body stays in a useful position, its swing is limited by two stops which act as brakes and are affixed so as to protrude perpendicularly from the attachment material. The invention is designed so that after the tool is inserted into the holder, the head of the tool remains secured by the cantilevering action of a spring-loaded clip against a dead-lock arm extending downwards from the holder body. The opposite end of the tool rests on an L-shaped extending at right angles from the attachment material. The tool is removed by the natural motion of grasping the handle and swinging upwards. This results in the tool being held in an immediately usable manner as it is withdrawn from the holder.

18 Claims, 4 Drawing Sheets

FIG. 3
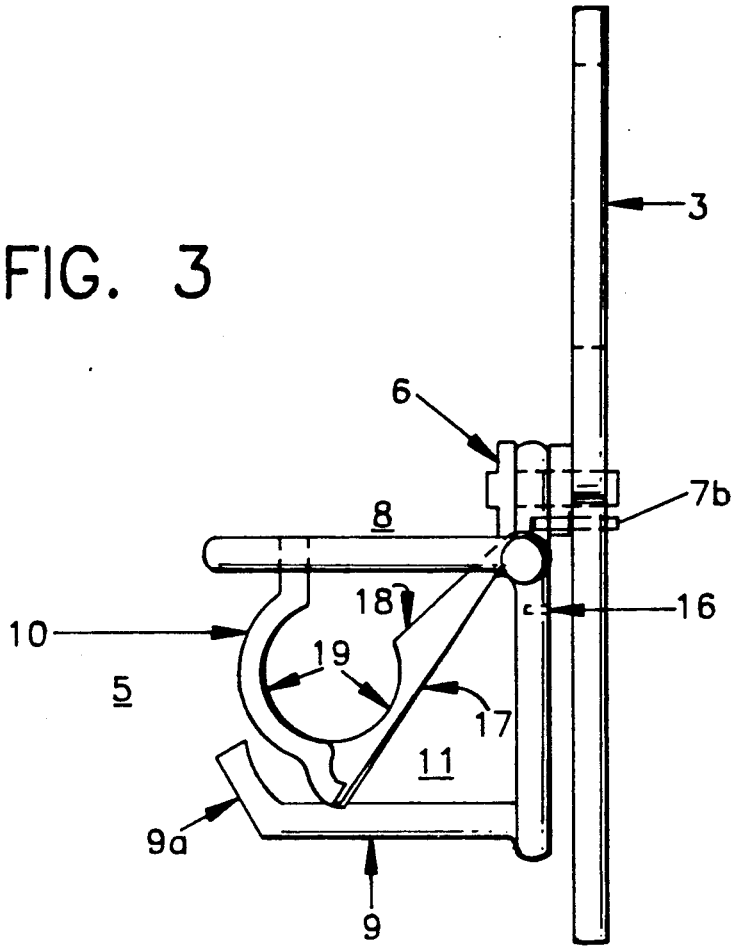
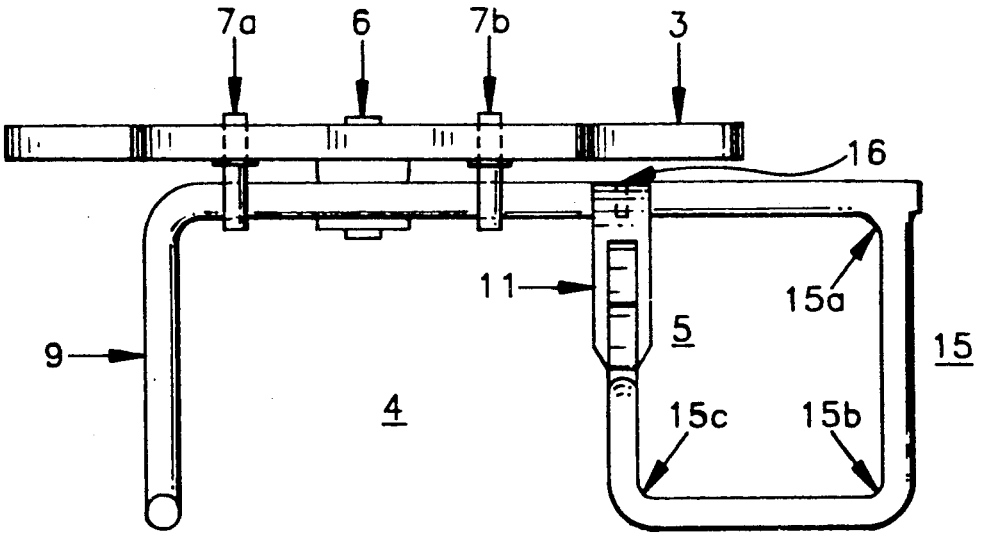
FIG. 4

TOOL HOLDER

This is a continuation of application Ser. No. 07/375,672, filed Jul. 5, 1989, now abandoned.

BACKGROUND OF THE INVENTION

1. Field of the Invention

This invention relates generally to a tool holder. More particularly this invention consists of apparatus for suspending a hammer or other T-shaped tool from a user's belt or from a stationary mount such as a tool box or wall.

2. Description of Prior Art

Carpenters and other craftspeople have continually sought ways in which their small tools could be comfortably carried and easily accessed on the job. For at least 100 years tool holders have been marketed which have—to varying degrees of success—met the goal of allowing workers to suspend such tools from their belts in such a way that the tools could be comfortably retrieved. Traditionally, these tool holders used as their key element a beltclip-supported wire loop shaped so as to form a cradle into which a hammer or other T-shaped tool could be placed. See, for example, U.S. Pat. No. 1,326,887 issued to Wood (1919) and, more recently, U.S. Pat. No. 4,638,530 issued to Perry (1987), both of which disclose a traditional belt-mounted loop-type cradle into which a tool can be placed.

As will be discussed in more detail in the following paragraphs, there are three primary drawbacks associated with the traditional loop-type cradles: 1) they leave the tool free to rotate and hence to snag clothing and other nearby objects, which snagging may in turn cause the tool to slip from the holder; 2) they do not prevent the tool from slipping out when the user is leaning over or for any other reason is in a non-upright orientation; 3) they require an awkward motion on the part of the user when the tool is to be inserted or withdrawn—that is, for both actions the tool must be held in a vertical orientation and positioned above the cradle.

It is because the traditional holders support the tool at a level which is below the tool's center of gravity that the tool is particularly prone to rotate and then to catch on clothing and other objects and occasionally fall out. An example of such a device is disclosed in U.S. Pat. No. 4,106,679 issued to Hillinger (1978). Furthermore, these traditional designs provide no affirmative way to forestall the tool's slipping out and falling when the user leans over or for any other reason changes the orientation of the belt on which the holder is mounted. In addition to the potential for marring clothing and other property, the unrestricted tool swing and lack of a tool-securing device render the traditional tool holder somewhat hazardous to workers and other present on a construction site, especially one involving multi-level projects.

The final problem alluded to is inherent in the simple traditional loop-type holders and relates to the relatively awkward motions required to insert the tool into the holder and to withdraw it from the holder. Specifically, the insertion of the tool requires that is first be positioned above the holder in an essentially vertical orientation with its handle directed downward. The handle is then slid down through the loop, which then catches and supports the body of the tool, which is too large to pass through. Withdrawal requires essentially the same motion in reverse, with the entire tool being raised above the holder in a more or less vertical orientation during retrieval. This lifting motion is awkward and inefficient for the user, who must subsequently re-position his grip in order to use the tool.

Several attempts have been made in the prior art to address the need for securing the tool. See, for example, U.S. Pat. No. 2,956,715 issued to Henderson (1960) and U.S. Pat. No. 3,100,590 issued to Bohlsen (1963), both disclosing holders which fully support and clasp the inverted tool by its body while making the tool handle readily available by storing the tool with the handle upwards. Unfortunately, because the center of gravity of the tool is now significantly below the point of attachment to the user's garment, the tool and holder tend to swing outward, and hence are uncomfortable to wear as well as being destructive to the clothing of the user.

U.S. Pat. No. 3,156,388 issued to Simmons (1964) addresses the ease-of-insertion/withdrawal problem mentioned above. It teaches a tool holder in which the tool is inserted by grasping the body of the tool and pushing it against two spring-loaded retaining jaws. The problem with this system is that in order to remove the tool the holder must be manipulated so that the retaining jaws are pushed back into their recessed position. The need to perform this additional manipulation constitutes a clear impediment and annoyance to the worker needing to retrieve and then stow the tool frequently. Likewise, U.S. Pat. No. 4,645,104 issued to Vokaty (1987) discloses a hammer holder having a cylindrical barrel into which the body of the tool can be placed. While solving the problem of the excessive swing and to a certain extent providing for a secure gripping of the tool by the holder, this design actually worsens the retrieval problem; it requires that—when stowing or retrieving the tool—the user hold the tool handle outward from his or her body at approximately a 90-degree angle. The motion required to orient the handle perpendicularly to one's body is unnatural and inefficient for the user, especially for one working in tight quarters. In a similar vein, U.S. Pat. No. 3,104,434 issued to Noordhoek (1962) also discloses a hammer hanger that secures the hammer by retaining it at its center of mass. However, the Noordhoek device fails to overcome the problem associated with providing a convenient means of stowing and retrieving the tool when the user is in an awkward position. In particular, the tool must be inserted into the holder in a specific way, and it must be withdrawn in the same manner.

Continuing attempts have been made to address the convenience-of-access question, with the goal of requiring only minimal storage/retrieval motion on the part of the user. U.S. Pat. No. 4,790,461 issued to Stover (1988) discloses a tool holder with a hinged gate. The tool is inserted by grasping the handle and swinging downwards; the tool is removed by grasping the handle and swinging upwards. However, no provision is made for securing the tool.

In summary, although attempts have been made through the years to address the problems of excess swing, grip security, and ease of storage and retrieval nothing in the prior art appears to deal adequately with all of these problems. What is needed is a tool holder that (1) grasps the mounted tool so as to prevent it from swinging excessively or from slipping free inadvertently and which (2) allows the user an easy and comfortable method by which to stow and retrieve the tool.

SUMMARY OF THE INVENTION

The broad objectives of this invention are to provide a tool holder that enhances the safety and efficiency of construction environments. These primary objectives are achieved by the invention's capacity to secure a T-shaped tool so as to avoid inadvertent removals while nevertheless allowing the user to insert and remove the tool easily and in a manner efficient to tool usage. The body of many such T-shaped tools can be further delineated into a primary striking face, a neck connecting the striking face to the body, and an end face. It has been observed that over a very wide range of hammer types and weights the neck diameter remains fairly uniform. Thus, a tool holder designed to grip the neck of the tool can be used with a surprisingly wide range of tool types. The invention secures the T-shaped tool by gripping the neck in a spring-loaded clip combined with a dead-lock arm. While allowing some motion it prevents excessive swing by means of limiting pegs which act as stops to the tool mount's rotation. Finally, the invention facilitates efficient tool usage with a hammer cradle design which allows for stowing and retrieval while the tool is gripped by the user in essentially the same manner it would be while in use. In fact, for most tools suspended from a belt no shift of grip is required. Furthermore, the hammer cradle, with its means for securing and supporting the tool, is affixed to the user's belt or the like at a pivot point. The tool is thus secured in close proximity to the pivot point, thereby overcoming the problems associated with the prior art devices. This is achieved by retaining the tool's center of mass near the attachment point of the cradle to the user's belt or the like.

BRIEF DESCRIPTION OF THE DRAWINGS

FIG. 3 shows a head on view of the preferred embodiment of the invention.

FIG. 4 shows a top view of the preferred embodiment of the invention.

PREFERRED EMBODIMENT OF THE INVENTION

Figure 1:
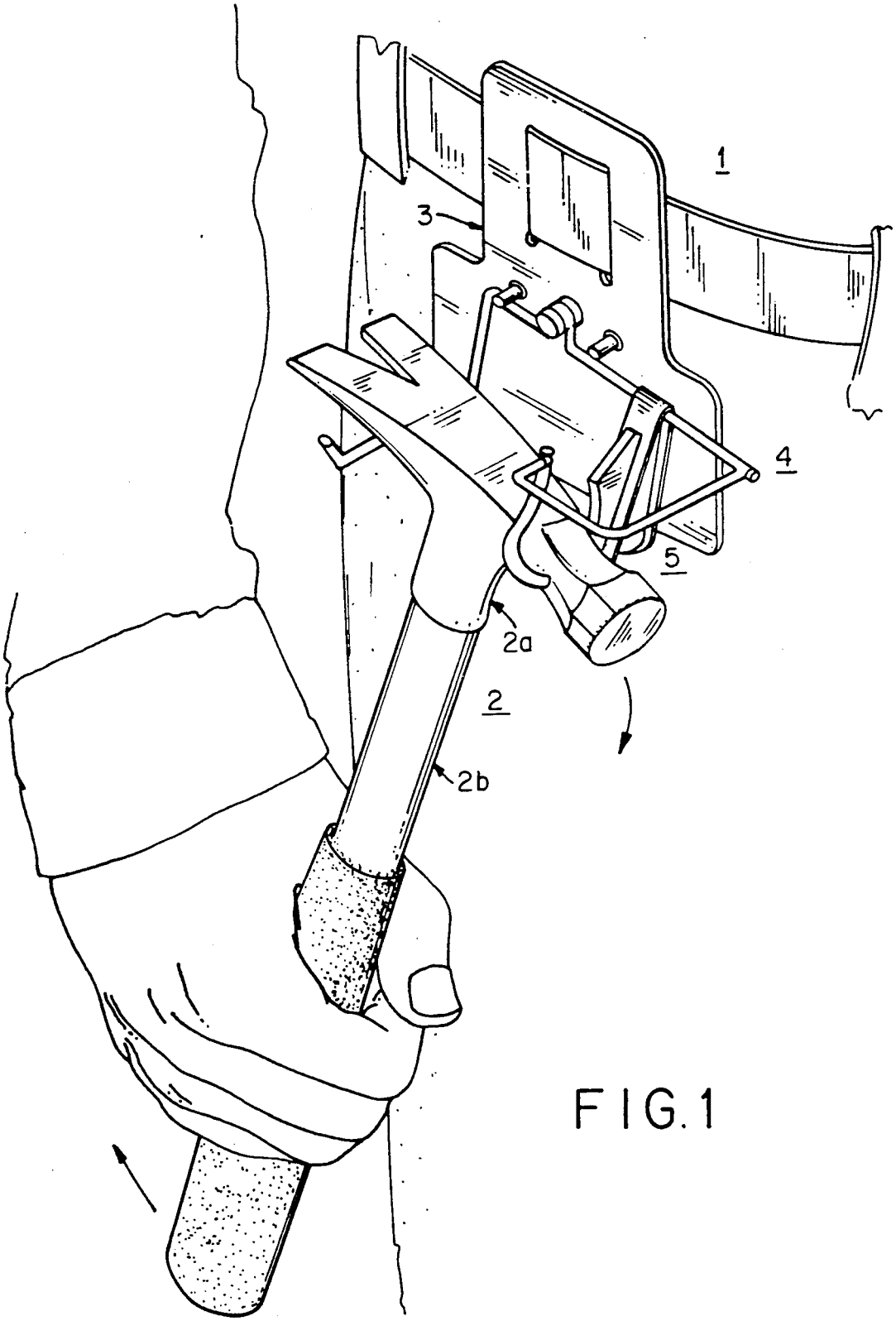
FIG. 1 shows a perspective view of the preferred embodiment of the invention in use in conjunction with a conventional claw hammer which is shown being retrieved by the user.

FIG. 1 shows the preferred embodiment of the tool holder 1 from which a user is retrieving a T-shaped tool 2 comprised of a tool body 2*a* and a tool handle 2*b*. The principal elements of said tool holder 1 comprise a slotted attachment pad 3 and a hammer cradle 4. Said hammer cradle 4 in turn encompasses a spring-loaded securing receptacle 5, which is the heart of the invention with respect to ease of tool stowing and retrieval.

Figure 2:
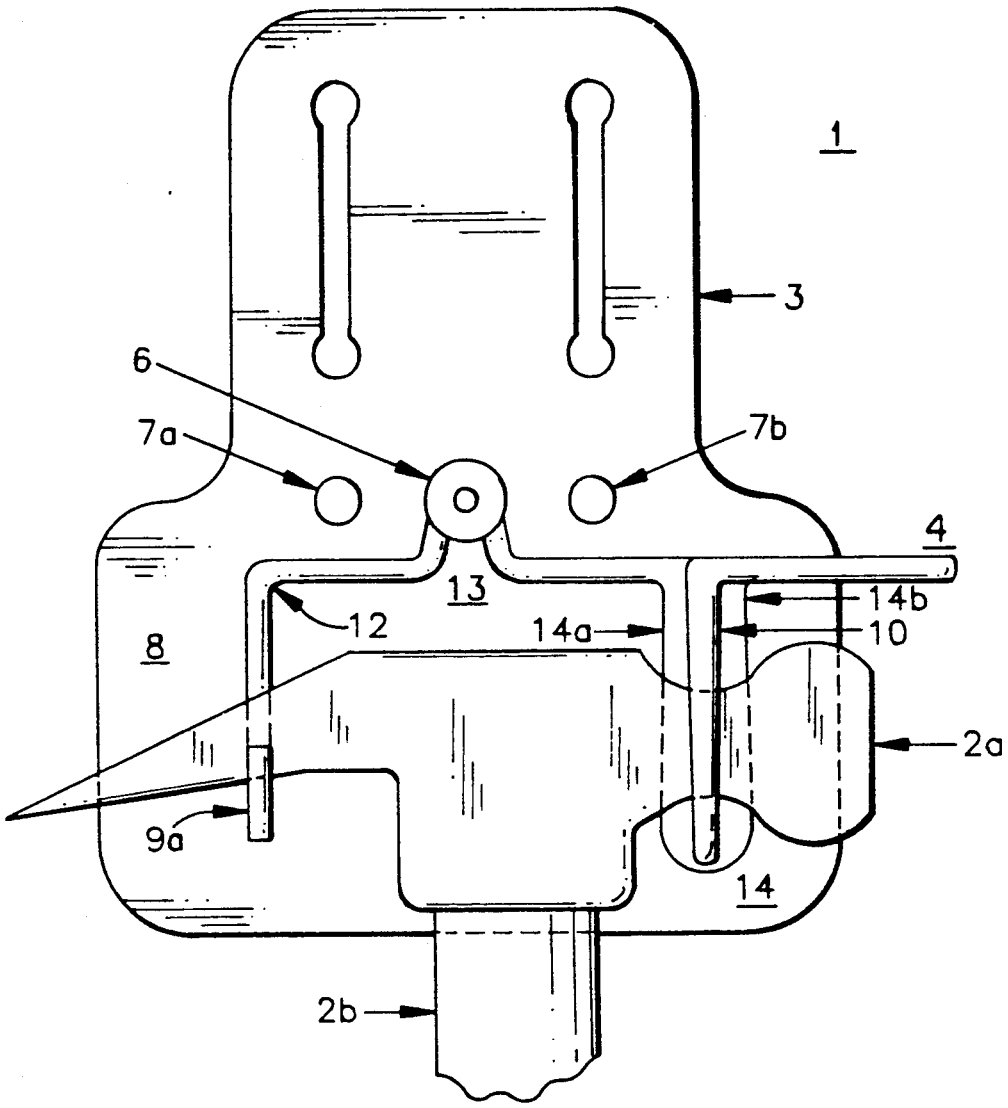
FIG. 2 shows a frontal view of the preferred embodiment of the invention in conjunction with a conventional claw hammer.

FIG. 2 depicts said T-shaped tool 2 supported and secured by said tool holder 1 and shows that said hammer cradle 4 is swivably affixed to said attachment pad 3 by a swivel rivet 6 which allows said hammer cradle 4 to pivot in such a manner that the primary plane which it defines remains parallel to the plane of said attachment pad 3. Pivot stop pins 7*a* and 7*b* affixed to said attachment pad 3 on either side of said swiveling rivet 6 limit the swing of said hammer cradle 4.

As FIG. 3 illustrates, said hammer cradle 4 is comprised of (1) a continuous rigid metal rod 8 configured so as to include a tool rest 9 extending perpendicularly away from the plane of said attachment pad 3, and (2) said spring-loaded securing receptacle 5. Said spring-loaded securing receptacle 5, in turn, is comprised of (1) a dead-lock arm 10 extending downwards from said rigid metal rod 8 and (2) a spring clip 11 extending downwards from said rigid metal rod 8 across from said dead-lock arm 10.

As is depicted in FIG. 3 said tool rest 9 is contoured with an L-shaped gutter 9*a*. FIG. 2 shows a profile view of said gutter 9*a* as it constrains said tool body 2*a* from slipping outward from said hammer cradle 4.

Said rigid metal rod 8 is contoured to have several distinct cradle-forming sections. FIG. 2 illustrates a right-angle bend 12, a horse-shoe loop 13 and a U-shaped loop 14. FIG. 4 best illustrates a guide loop 15.

Said right-angle bend 12 allows said rigid metal rod 8 to extend downwards so that said tool rest 9 is opposite the bottom of the lower portion of said dead-lock arm 10. The relationship between said tool rest 9 and said dead-lock arm 10 is chosen to insure that said tool body 2*a* is level while T-shaped tool 2 is stowed in said tool holder 1.

Said horse-shoe loop 13 is that portion of said rigid metal rod 8 which extends over said swivel rivet 6 and thus allows said hammer cradle 4 to pivot parallel to said attachment pad 3. Said horse-shoe loop 13 is critical for optimum tool storage because it allows said hammer cradle 4 to pivot and thus enhances a user's ability to remove said T-shaped tool 2 in a completely natural motion, namely, by grasping said tool handle 2*b* and swinging it upwards while simultaneously pulling backwards as illustrated in FIG. 1. Said T-shaped tool 2, upon its removal is already gripped by the user in a position making it ready for use.

Said U-shaped bend 14 allows said spring clip 11 to be affixed to said hammer cradle 4 by a spring fastener 16. Said U-shaped bend 14 is comprised of two sides 14*a* and 14*b*. Said sides 14*a* and 14*b* act as brakes by limiting the counter-clockwise swing of said spring clip 11.

Said guide loop 15 is comprised of a first 90-degree bend 15*a*, a second 90-degree bend 15*b* and a third 90-degree bend 15*c*. Said first and second 90-degree bends 15*a* and 15*b* form the front of said hammer cradle 4. Said third 90-degree bend 15*c* turns said rigid metal rod 8 towards said spring clip 11 so that said dead-lock arm 10 extends downwards from said rigid metal rod 8 directly across from said spring clip 11.

Said guide loop 15 allows said tool body 2*a* to sink into said spring loaded securing receptacle 5. It is critical for optimum tool storage that said guide loop 15 is ample enough in dimension to allow said tool body 2*a* to enter said spring-loaded securing receptacle 5 easily.

Said spring clip 11 is comprised of a spring steel piece 17 bonded to a shaped holder 18. Said spring clip 11 extends diagonally downward from said rigid metal rod 8 so as to connect with said dead-lock arm 10. FIG. 3 shows that both said dead-lock arm 10 and said spring clip 11 are shaped so as to bow outwardly and to connect securely to one another so that said dead-lock arm 10 and said spring clip 11 form a substantially conical inside surface 19 for the purpose of confining said tool body 2*a*. Said spring clip 11 is critical to optimum tool storage because it prevents said tool 2 from jostling while its user engages in activities. Furthermore, said spring clip 11 in combination with said dead-lock arm 10 allows said tool to be removed by grasping either said tool body 2*a* or said tool handle 2*b*.

Figure 5:
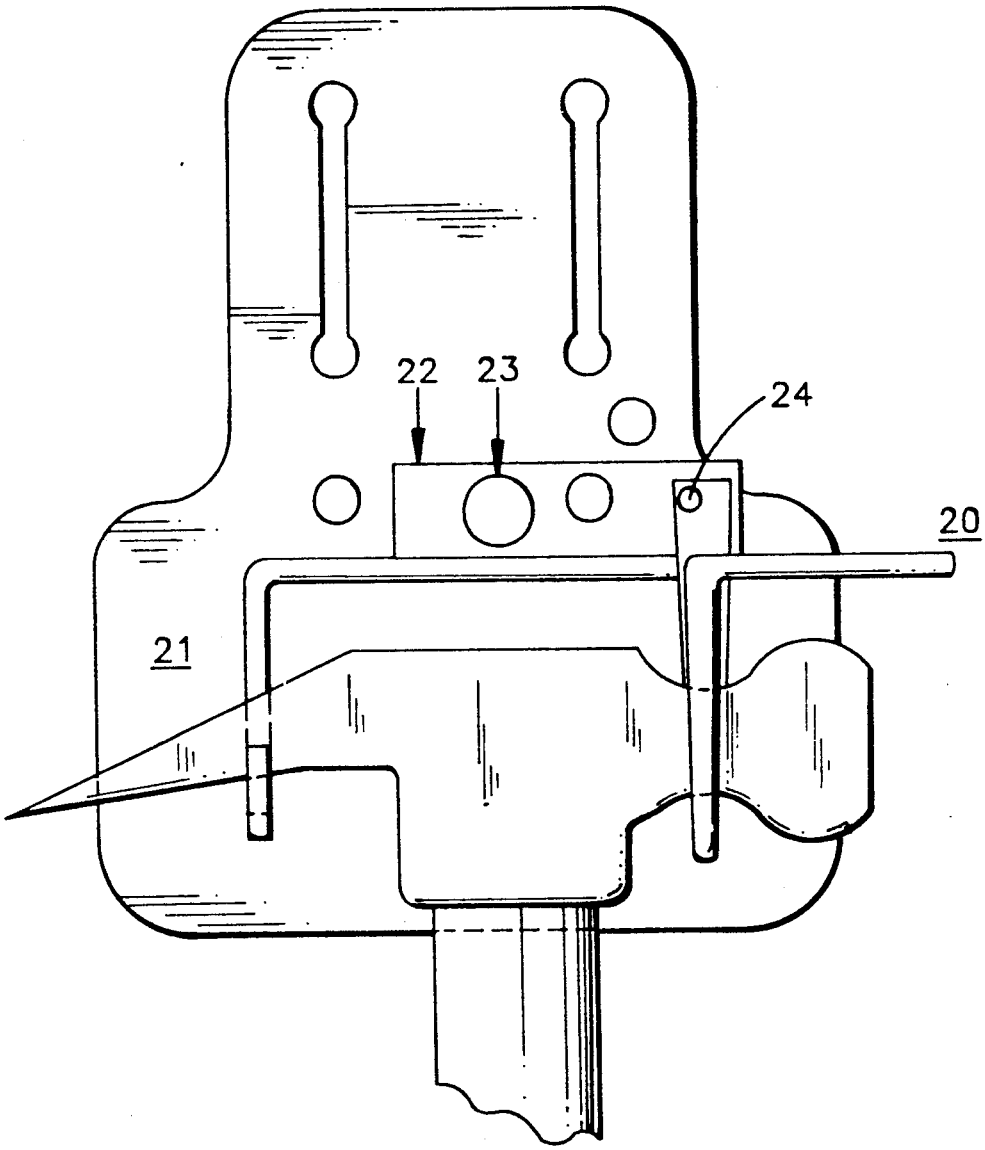
FIG. 5 shows a frontal view of the invention with a modified rocker cradle configuration.

FIG. 5 shows as an alternative configuration, the invention encompassing a modified hammer cradle 20 comprising a rigid metal rod 21 and a rectangular component 22 which eliminates said horse-shoe loop 13 and said U-shaped loop 14 of the above-described embodiment. Said rectangular component 22 contains a pivot fastener hole 23 and a spring attachment rivet 24.

It is to be understood, of course, that the foregoing description relates to particular embodiments of the general invention and that modifications or alterations of these embodiments may be made without departing from the spirit or scope of the invention as set forth in the appended claims.

I claim:

1. Apparatus for holding a tool which includes a handle at one end of the tool and a head at an opposite end of the tool, the handle being attached to the head intermediate a first end thereof and a second end thereof, said apparatus comprising attaching means for attaching said apparatus to a user's belt on one side of the user; supporting means for supporting the tool such that the head is arranged generally horizontally with the first end thereof facing in a rearward direction relative to the user and with the second end thereof facing in a forward direction relative to the user and such that the handle is arranged generally vertically below the head; mounting means for pivotally mounting said supporting means to said attaching means such that said supporting means is pivotable in one arcuate direction from an intermediate position toward a first terminal position in which the handle of the tool points generally in said rearward direction and such that said supporting means is pivotable in an opposite arcuate direction from said intermediate position to a second terminal position in which the handle of the tool points generally in said forward direction; first retaining means, provided on a rearward portion of said supporting means, for releasably retaining the first end of the head; and second retaining means, provided on a forward portion of said supporting means, for releasably retaining the second end of the head, said second retaining means including releasing means for releasing the second end of the head from said second retaining means in response to the pivotal movement of said supporting means from said intermediate position to said first terminal position as a result of the user pulling rearwardly and upwardly on the handle of the tool, said first and second retaining means being spaced apart so as to form an opening therebetween, said opening being sized and shaped so as to permit the tool to be inserted into said supporting means from an outwardly facing side thereof, whereby the user may stow and retrieve the tool while gripping the handle in the manner normally employed when the tool is in use.

2. Apparatus according to claim 1, wherein said second retaining means includes a stationary member and wherein said releasing means includes a movable member mounted such that said movable member is movable toward and away from said stationary member.

3. Apparatus according to claim 2, wherein said releasing means further includes urging means for resiliently urging said movable member toward said stationary member.

4. Apparatus according to claim 3, wherein said urging means includes a spring clip.

5. Apparatus according to claim 4, wherein said movable member is moved away from said stationary member in response to the pivotal movement of said supporting means from said intermediate position toward said first terminal position as a result of the user pulling rearward and upward on the handle of the tool.

6. Apparatus according to claim 5, wherein said stationary member includes first confining means for confining the second end of the tool on one side thereof and wherein said movable member includes second confining means for confining the second end of the tool on an opposite side thereof, whereby said first and second confining means cooperate to confine the second end of the tool therebetween.

7. Apparatus according to claim 6, wherein said first confining means includes a first arcuate surface on said stationary member and wherein said second confining means includes a second arcuate surface on said movable member.

8. Apparatus according to claim 7, wherein said first and second arcuate surfaces have shapes which substantially match the shape of the second end of the tool, whereby the second end of the tool is maintained in a substantially stationary position while it is confined between said first and second confining means.

9. Apparatus according to claim 8, wherein said first retaining means includes an L-shaped member having a generally outwardly extending leg sized and shaped so as to permit the first end of the tool to rest loosely thereon and a generally upwardly extending leg sized and shaped so as to inhibit the first end of the tool from sliding outwardly and off of said L-shaped member.

10. Apparatus according to claim 9, wherein said supporting means is pivotable about a pivot axis located above said first and second retaining means, whereby the center of gravity of the tool is below said pivot axis.

11. Apparatus according to claim 10, further comprising first limiting means for limiting the pivotal movement of said supporting means in said one arcuate direction and second limiting means for limiting the pivotal movement of said supporting means in said opposite arcuate direction.

12. Apparatus according to claim 11, wherein said first limiting means determines said first terminal position and wherein said second limiting means determines said second terminal position.

13. Apparatus according to claim 12, wherein said first limiting means includes a first stop pin positioned rearwardly of said pivot axis and wherein said second limiting means includes a second stop pin positioned forwardly of said pivot axis.

14. Apparatus according to claim 13, wherein said first and second stop pins are arranged at the same elevation as said pivot axis.

15. Apparatus according to claim 13, wherein said first stop pin is arranged at the same elevation as said pivot axis and wherein said second stop pin is arranged at an elevation which is higher than that of said pivot axis.

16. Apparatus according to claim 13, wherein said attaching means includes a substantially planar body.

17. Apparatus according to claim 16, wherein said pivot axis extends outwardly from said body in a direction normal to an imaginary plane containing said body.

18. Apparatus according to claim 17, wherein said body includes slots sized and shaped so as to receive the user's belt.

* * * * *

UNITED STATES PATENT AND TRADEMARK OFFICE

CERTIFICATE OF CORRECTION

PATENT NO. : 5,195,667

DATED : March 23, 1993

INVENTOR(S) : David Gallant

It is certified that error appears in the above-identified patent and that said Letters Patent is hereby corrected as shown below:

In the Abstract

Item 57, line 14, after "L-shaped", insert --support--.

Signed and Sealed this

Twelfth Day of July, 1994

Bruce Lehman

*Attest:*

BRUCE LEHMAN

*Attesting Officer*

*Commissioner of Patents and Trademarks*